US010018042B2

(12) United States Patent
Lenaburg

(10) Patent No.: US 10,018,042 B2
(45) Date of Patent: Jul. 10, 2018

(54) CLAMPED-RING CUTTER ASSEMBLY FOR TUNNEL BORING MACHINE

(71) Applicant: The Robbins Company, Solon, OH (US)

(72) Inventor: Carl E. Lenaburg, Tacoma, WA (US)

(73) Assignee: The Robbins Company, Solon, OH (US)

( * ) Notice: Subject to any disclaimer, the term of this patent is extended or adjusted under 35 U.S.C. 154(b) by 83 days.

(21) Appl. No.: 15/336,530

(22) Filed: Oct. 27, 2016

(65) Prior Publication Data

US 2017/0122104 A1 May 4, 2017

Related U.S. Application Data

(60) Provisional application No. 62/249,022, filed on Oct. 30, 2015.

(51) Int. Cl.
*E21D 9/10* (2006.01)

(52) U.S. Cl.
CPC ..... *E21D 9/104* (2013.01)

(58) Field of Classification Search
CPC ..... E21D 9/104
See application file for complete search history.

(56) References Cited

U.S. PATENT DOCUMENTS 1,846,212 A * 2/1932 Kubin ..... E21B 10/12 175/351
2,223,864 A 12/1940 Zublin
2,306,683 A 12/1942 Zublin
3,191,699 A * 6/1965 Robbins ..... E21B 10/12 175/374

(Continued)

FOREIGN PATENT DOCUMENTS

EP 0602753 A1 * 6/1994 ..... E21B 10/12
JP 3722885 B2 11/2005

(Continued)

OTHER PUBLICATIONS

Espallargas, N., et al., "Influence of Corrosion on the Abrasion of Cutter Steels Used in TBM Tunnelling," Rock Mechanics and Rock Engineering 48(1):261-275, Jan. 2015.

(Continued)

*Primary Examiner* — John J Kreck
(74) *Attorney, Agent, or Firm* — Christensen O'Connor Johnson Kindness PLLC

(57) ABSTRACT

A cutter assembly includes a disc subassembly rotatably mounted on a shaft with bearing assemblies, and end retainers. The disc subassembly includes a first hub member having a tubular portion that houses the bearing assemblies and an outer flange portion, a second hub member that slidably engages the tubular portion, and an annular cutter ring, preferably formed from a tool steel, and optionally formed in a plurality of segments. The first and second hub members define a channel that receives and clampingly engages a rectangular inner base portion of the cutter ring. The clamping force is provided by a plurality of bolts that join the first and second hub members, while the flange portion of the first hub member remains separated from the second hub member by a gap (S). In an embodiment the cutter ring includes a carbide core.

28 Claims, 6 Drawing Sheets

(56) References Cited

U.S. PATENT DOCUMENTS

| | | | | | |
|---|---|---|---|---|---|
| 3,734,213 | A * | 5/1973 | Goodfellow | E21B 7/28 175/374 |
| 3,766,998 | A * | 10/1973 | Bower, Jr. | E21B 10/12 175/372 |
| 3,982,595 | A * | 9/1976 | Ott | E21B 10/12 175/351 |
| 5,234,064 | A | 8/1993 | Lenaburg | |
| 5,904,211 | A * | 5/1999 | Friant | E21B 10/12 175/228 |
| 6,367,569 | B1 | 4/2002 | Walk | |
| 7,017,683 | B2 | 3/2006 | Narvestad | |
| 7,997,659 | B2 | 8/2011 | Oertley et al. | |
| 8,783,786 | B2 | 7/2014 | Shanahan et al. | |
| 2009/0079256 | A1 | 3/2009 | Oertley et al. | |
| 2012/0212034 | A1 | 8/2012 | Shanahan et al. | |
| 2014/0251696 | A1 | 9/2014 | Cox | |
| 2015/0028657 | A1 | 1/2015 | Narvestad | |

FOREIGN PATENT DOCUMENTS

| | | | |
|---|---|---|---|
| JP | 3901330 | B2 | 4/2007 |
| KR | 10-20140049977 | A | 4/2014 |

OTHER PUBLICATIONS

International Search Report and Written Opinion dated Feb. 13, 2017, issued in corresponding International Application No. PCT/US2016/059202, filed Oct. 27, 2016, 17 pages.

International Search Report and Written Opinion dated Feb. 15, 2017, issued in corresponding International Application No. PCT/US2016/059433, filed Oct. 28, 2016, 12 pages.

* cited by examiner

CLAMPED-RING CUTTER ASSEMBLY FOR TUNNEL BORING MACHINE

CROSS-REFERENCE TO RELATED APPLICATION

This application claims the benefit of U.S. Provisional Patent Application No. 62/249022, filed Oct. 30, 2015, the disclosure of which is hereby incorporated by reference herein.

BACKGROUND

A tunnel boring machine ("TBM") is a tunnel excavation apparatus for constructing a tunnel through soil and rock strata. Modern TBMs produce a smooth circular tunnel wall, typically with minimal collateral disturbance. A breakthrough that made TBMs efficient and reliable was the invention of the rotatable cutter assembly, developed by James S. Robbins, which is configured to be mounted on a rotating cutterhead. Previous TBMs used rigidly-mounted spikes on a rotating head that were positioned to engage and bore into the ground. However, the rigidly-mounted spikes would often break, resulting in frequent and expensive downtime for the TBM. Robbins discovered that by replacing the rigid spikes with rotatable cutter assemblies the reliability of the TBM was greatly improved. Since then, successful modern TBMs have rotatable cutter assemblies.

Modern TBMs employ rotating cutterheads with rotatable disc cutter assemblies that are mounted to the cutterhead. The cutterhead is urged against the target surface with a large thrust force, for example, using a plurality of hydraulic cylinders or other mechanical actuators, such that the cutter assemblies engage the surface. As the cutterhead rotates, the rotatable cutter assemblies fracture, crush, and/or loosen materials which are then transported away by the TBM as the TBM progresses to bore the tunnel.

FIG. 1 is a cross-sectional view of a prior art cutter assembly 80 for a tunnel boring machine (TBM not shown). See, for example, U.S. Pat. No. 5,904,211, to Friant et al., which is hereby incorporated by reference in its entirety. The cutter assembly 80 includes a shaft 81 that is configured to be fixedly attached to the TBM rotating cutterhead. An annular cutter ring 82 (sometimes called a cutter disc) is attached to a hub 83 with an interference fit between the hub 83 and the cutter ring 82, and positioned with retainer ring 84, to form a ring assembly 85. The ring assembly 85 is rotatably mounted to the shaft 81 with a pair of bearing assemblies, in this embodiment comprising an inner bearing race 87, an outer bearing race 88, and a plurality of tapered roller bearings 89. End retainers 90, 91 are disposed on either side of the bearing assemblies. During operation, the ring assembly 85 is rotatable about the shaft 81, and the end retainers 90, 91 are fixed to the shaft 81.

A rotary seal group 92 is provided at the interface between each of the end retainers 90, 91 and the ring assembly 85. The rotary seal groups 92 are mechanical face seals, also referred to as duo cone seals. The mechanical face seals were developed for protecting equipment working in the most adverse conditions, and comprise a pair of annular metal seal rings 93, and a pair of elastic toric members 94 (e.g., O-rings). The outer metal seal ring 93 engages the associated end retainer 90 or 91 through a toric member 94 and is fixed, and the associated inner metal seal ring 93 engages the ring assembly 85 through a toric member 94 and rotates. The two associated metal seal rings 93 abut to form a moving seal interface there between. Typically the available interior volume between the end retainers 90, 91 is filled with a lubricant, e.g., oil or grease. The rotary seal groups 92 provide a seal to prevent the incursion of dirt that could damage or destroy the bearing assemblies.

An alternative approach to a TBM cutter assembly construction is disclosed in U.S. Pat. No. 7,017,683, to Narvestad. Narvestad discloses a divided cutter ring mounted on a tubular cutter body having a slanted surface on one side that receives a correspondingly angled base of the cutter ring. A clamping ring with a slanted inner surface is threadably tightened onto the tubular cutter body opposite the cutter ring to capture the wide base of the cutter ring in a dovetail arrangement. The cutter ring construction disclosed by Narvestad includes a relatively large and massive base portion, so the cutter ring remains relatively costly.

There exists a need for improved cutter assemblies for tunnel boring machines.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A cutter assembly for a tunnel boring machine includes a shaft that rotatably mounts a disc subassembly that includes a first hub member with a tubular portion and a flange portion, a second hub member that slidably receives the tubular portion of the first hub member, and an annular cutter ring. The first and second hub members each define an annular L-shaped channel, and the cutter ring is cooperatively supported by the L-shaped channels. The first and second hub members are clamped together with a plurality of bolts that extend through apertures in the hub members, for example, threadably engaging apertures in one or the other of the hub members, such that the first and second hub member clampingly engage a base portion of the annular ring.

In an embodiment the cutter ring is formed in a plurality of separable segments that cooperatively form the cutter ring.

In an embodiment the base of the cutter ring is wider than the combined width of the L-shaped channels such that a gap is defined between the L-shaped channels.

In an embodiment the apertures in the first hub member are unthreaded and uniformly spaced along a circular pattern.

In an embodiment the base portion of the cutter ring defines opposed walls that do not diverge by more than fifteen degrees.

In an embodiment the base portion of the cutter ring defines opposed walls that are parallel.

In an embodiment the annular cutter ring is formed from a tool steel.

In an embodiment the plurality of bolts include at least ten bolts.

In an embodiment the disc subassembly is rotatably mounted to the shaft with two tapered bearing assemblies.

In an embodiment the cutter assembly also includes first and second retainers that are fixedly mounted to the shaft and sealingly engaging the first and second hub members respectively.

In an embodiment the annular cutter ring has a tapered portion extending radially from the cutter ring base.

A cutter assembly for a tunnel boring machine includes a shaft for mounting to a tunnel boring machine, a first hub member having a flange portion and a housing portion, wherein the housing portion is mounted to the shaft with first and second bearing assemblies, a second hub member that slidably engages the housing portion of the first hub member, and an annular cutter ring with a rectangular base portion and a tapered outer portion. The first and second hub members are joined together with a plurality of bolts, and cooperatively define an annular channel that receives and clampingly engages the base portion of the annular cutter ring.

In an embodiment the annular cutter ring is forms from a plurality of separable segments that cooperate to form the annular cutter ring.

In an embodiment the flange portion of the first hub member is spaced apart from the second hub member.

In an embodiment the first hub member has a plurality of spaced apart holes that receive the plurality of bolts, and the second hub member comprises a corresponding plurality of threaded apertures that engage the plurality of bolts, for example, at least ten bolts.

In an embodiment the base portion of the cutter ring defines opposed walls that diverge by not more than six degrees.

In an embodiment the base portion of the cutter ring defines opposed walls that are parallel.

In an embodiment the cutter ring is tool steel, and includes a tapered outer portion.

In an embodiment the cutter assembly also includes a pair of retainers mounted to the shaft that engage the hub members.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Tunnel boring machines (TBMs) typically include a large number of cutter assemblies that are mounted for rotation on the TBM cutterhead. See, for example, U.S. Pat. No. 9,010,872, to Lenaburg, which is hereby incorporated by reference in its entirety. The number of cutter assemblies mounted to the cutterhead may depend on the particular design of the TBM, for example the diameter of the cutterhead, and the environment associated with the tunnel boring application, for example the composition of the ground conditions for the particular tunneling application.

The TBM, and in particular the cutter assemblies rotatably mounted on the cutterhead, are subjected to extreme stress conditions. The cutter assemblies are urged against rock and/or mixed ground conditions under forces sufficient to cause rock surfaces contacted by the cutter assembly to crush, develop ,fractures and/or otherwise fail. Mixed ground conditions may include sections of hard rock, soft ground, boulders, and the like. The TBM may operate continuously for long periods of time, producing significant heating, raising the temperature of the cutter assembly. Moreover, repair and maintenance of the cutter assembly is difficult and expensive due to the difficulty in accessing the cutter assembly in situ, and the costs associated with having to halt boring activities during any maintenance periods.

The cutter ring portion of TBM cutter assemblies are typically formed from high quality, expensive, tool steel. Such tool steel alloys are difficult and expensive to fabricate and machine. Notwithstanding the use of high-quality tool steel, however, cutter assemblies wear significantly during tunnel boring operation, and are considered consumable items for tunnel boring operations as they must be replaced or refurbished at regular intervals. In a conventional cutter assembly the tool steel material used to manufacture the cutter ring typically makes up about 85% of the disc cost.

Figure 2:
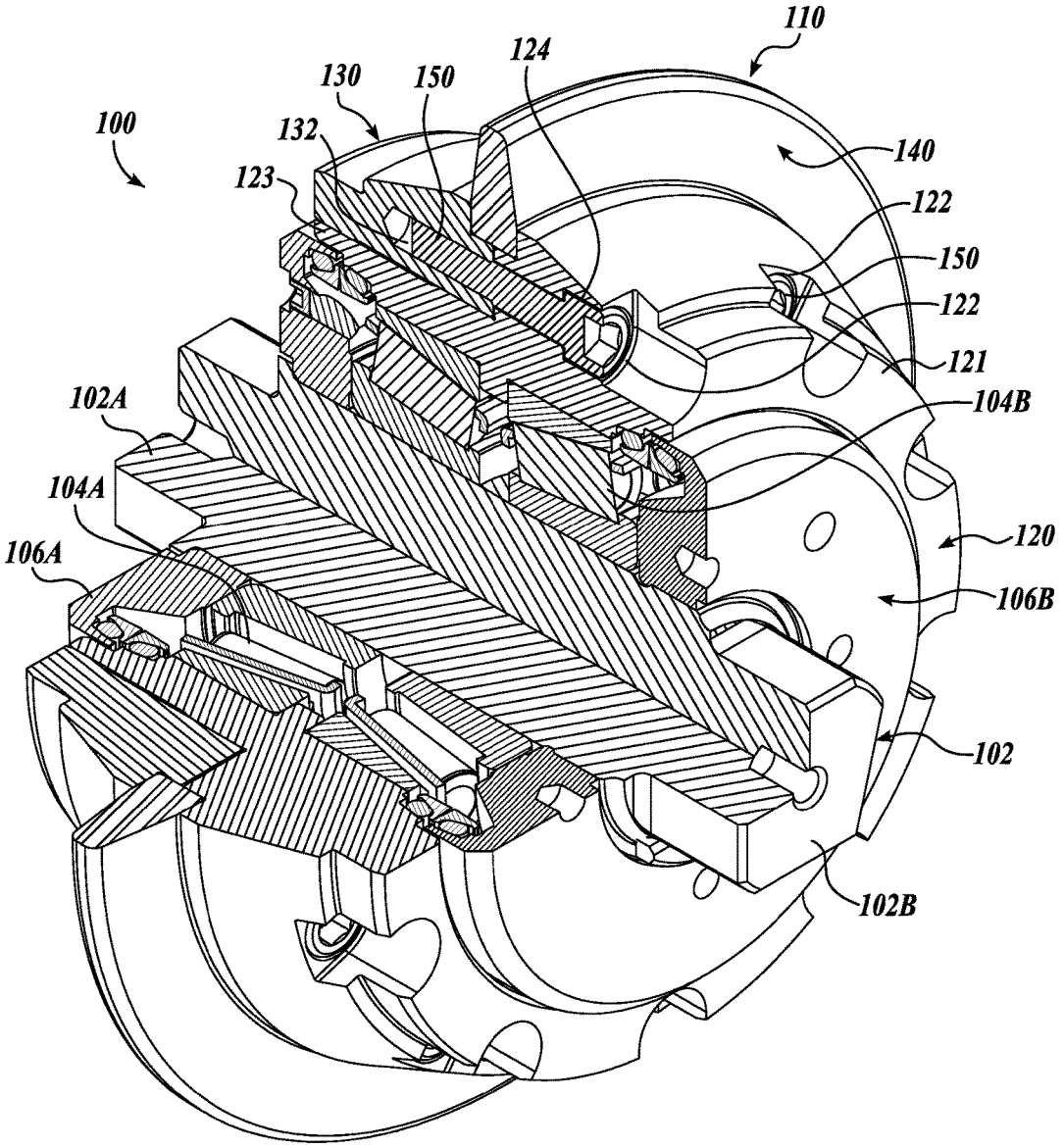
FIG. 2 is a quarter-sectioned perspective view of a cutter assembly in accordance with the present invention.
Figure 3:
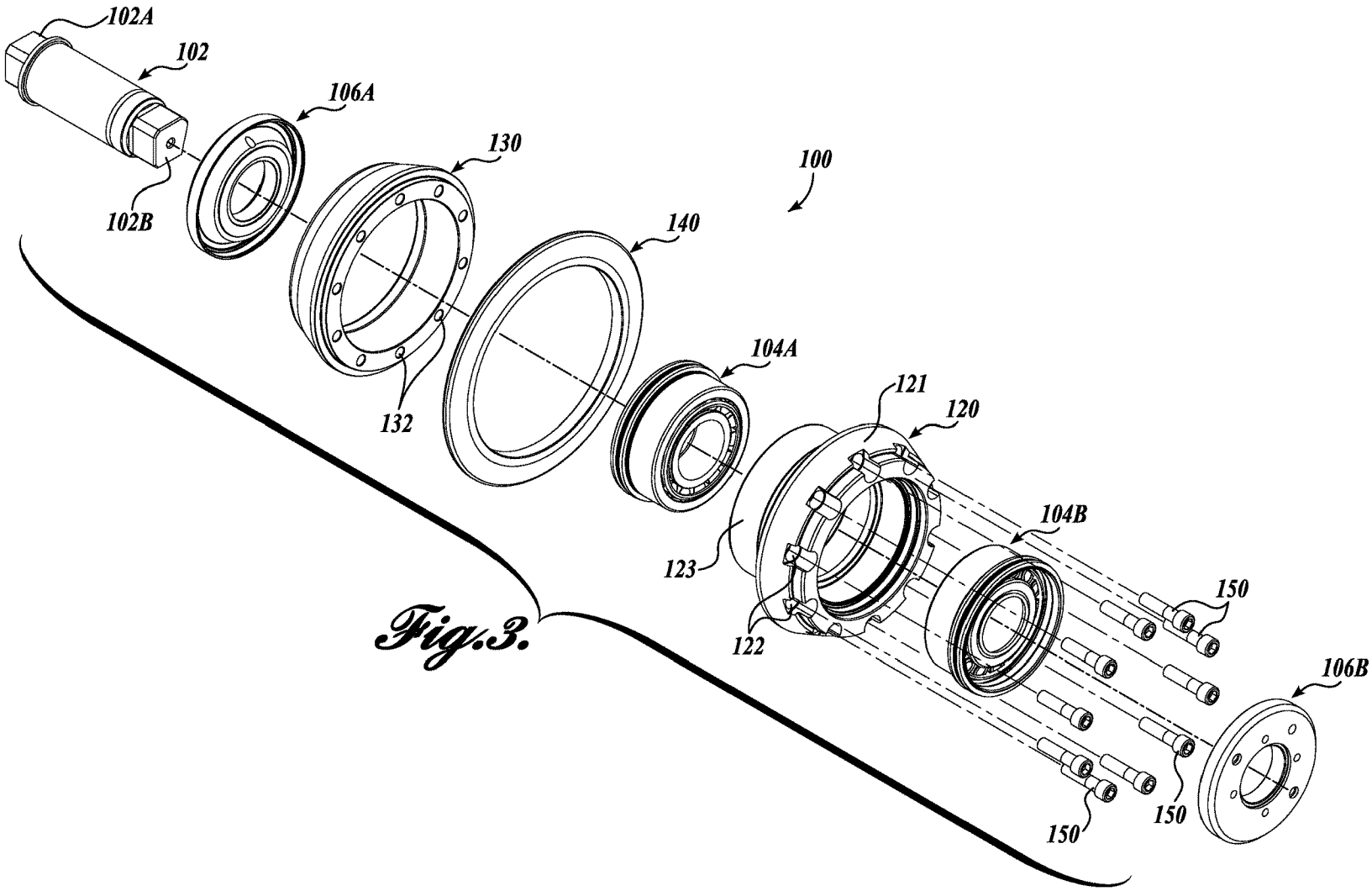
FIG. 3 is a partially exploded view of the cutter assembly shown in FIG. 2.
Figure 4:
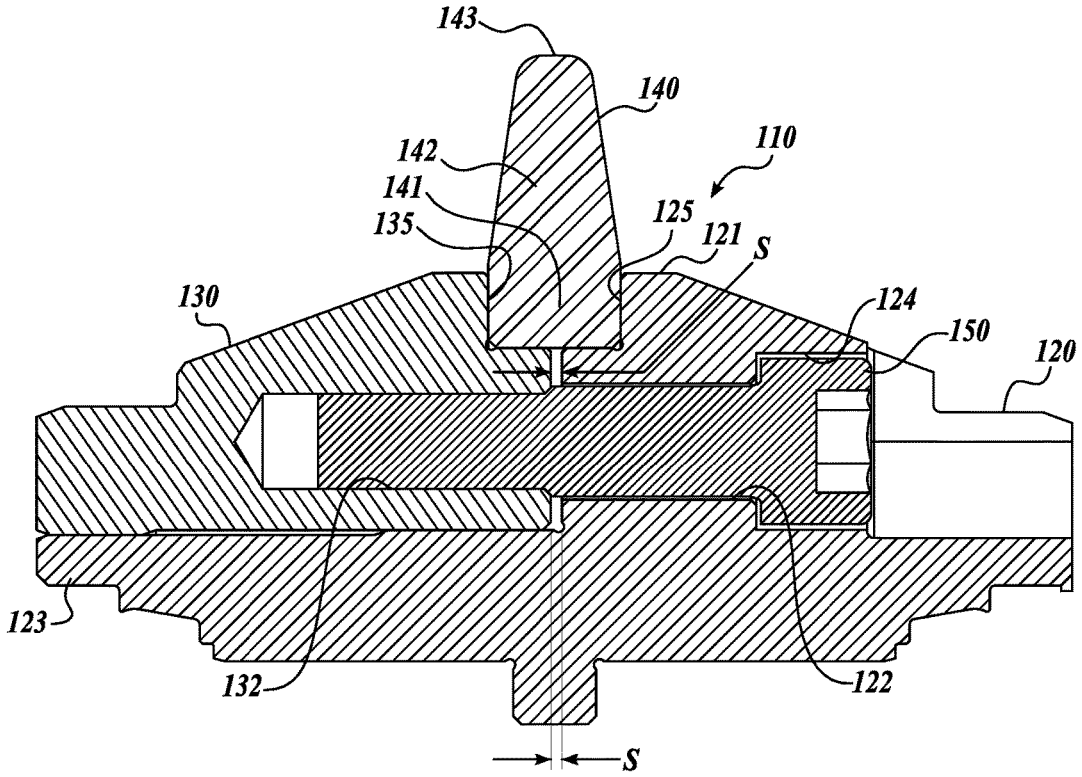
FIG. 4 is a detail cross-sectional view of the cutter ring assembly for the cutter assembly shown in FIG. 2.

FIGS. 2-4 show a clamped-ring cutter assembly 100 in accordance with the present invention that provides advantages over prior art cutter assemblies. FIG. 2 is a quarter-sectional view of the clamped-ring cutter assembly 100, and FIG. 3 shows a partially exploded perspective view of the clamped-ring cutter assembly 100.

A significant advantage of the clamped-ring cutter assembly 100 is a reduction in the costs of the disc subassembly 110 due in part to a reduction in the amount of expensive tool steel alloy required for each cutter assembly 100, and to a reduction in fabrication costs associated with manufacturing the tool steel component due to a simplified cutter ring 140.

The clamped-ring cutter assembly 100 includes a disc subassembly 110, comprising a first hub member 120, a second hub member 130, and a cutter ring 140 that is clamped between the first and second hub members 120, 130.

The first hub member 120 has a tubular portion 123 that extends axially from a body or flange portion 121. The tubular portion 123 has an inner diameter sized and configured to receive a pair of bearing assemblies 104A, 104B that rotatably mount the disc subassembly 110 to a shaft 102. The shaft 102 has shaped ends 102A, 102B for securing the cutter assembly 100 to a cutter housing for mounting the cutter assembly 100 to the cutterhead (not shown). The flange portion 121 of the first hub member 120 extends radially outwardly on one end of the tubular portion 123, and includes a plurality of circumferentially-spaced apertures 122 that are sized to receive corresponding bolts 150 (ten shown). Preferably, each of the apertures 122 include an enlarged portion 124 sized to receive the heads of a corresponding bolt 150.

The second hub member 130 comprises an annular body having an inner surface that slidably engages the tubular portion 123 of the first hub member 120. Although in the current embodiment the tubular portion 123 of the first hub member 120 and the inner surface of the second hub member are circular and configured to slidably engage, in alternative embodiments the first and second hub members 120, 130 may have one or more axial features (for example a matched rib and channel) such that the first and second hub members 120, 130 are rotationally locked when they slidably engage. Other engagement methods are also contemplated.

In this embodiment, the second hub member 130 has a plurality of threaded apertures 132 that are sized and positioned to align with a corresponding one of the apertures 122 in the body portion 121 of the first hub member 120. The first and second hub members 120, 130 may therefore be connected with the plurality of bolts 150. Other attachment hardware may alternatively be used, as are known in the art.

For example, the apertures 132 rather than being threaded may be sized and shaped to receive nuts for engaging corresponding bolts 150. Alternatively, or additionally, the first and second hub members 120, 130 may threadably engage.

FIG. 4 is a cross-sectional view of a radially outer section of the disc subassembly 110. The flange portion 121 of the first hub member 120 defines a first annular L-shaped channel 125 on a radially outer edge, and the second hub member 130 defines a second annular L-shaped channel 135 on a radially outer edge.

The cutter ring 140 is an annular structure formed from tool steel, and is configured to fit over the tubular portion 123 of the first hub member 120, and to slidably engage the first L-shaped channel 125 and the second L-shaped channel 135. The first and second channels 125, 135 are configured to cooperatively receive the inner radius of the cutter ring 140.

In the current embodiment the cutter ring 140 has an inner annular base portion 141 that is substantially rectangular in cross-section, and an outer portion 142 defining an end portion 143 that is configured to engage the rock face during use. The opposed walls in the base portion 141 in this embodiment are parallel. In an alternative embodiment the opposed walls of the base portion 141 of the cutter ring 140 may angle slightly from parallel in the radial direction. For example, the opposed walls may define an included angle of fifteen degrees or less. In another embodiment the opposed walls do not diverge by more than six degrees.

As shown in FIG. 4, the first and second annular L-shaped channels 125, 135 and the cutter ring 140 are configured such that a gap S is defined between the flange portion 121 of the first hub member 120 and the second hub member 130 when the cutter ring 140 is clampingly retained in the first and second channels 125, 135. When the disc subassembly 110 is assembled, the bolts 150 extend through the apertures 122 in the first hub portion, and engage the threaded apertures 132 in the second hub member 130. In the embodiment of FIG. 3 there are ten bolts 150 and corresponding spaced-apart apertures 122, 132. The bolts 150 may be tightened to achieve a desired uniform clamping force on the parallel faces of the base portion 141 of the cutter ring 140. In other embodiments more or fewer bolts may be used. The number of bolts for a particular cutter assembly may depend, for example, on the diameter of the cutter assembly.

Figure 1:
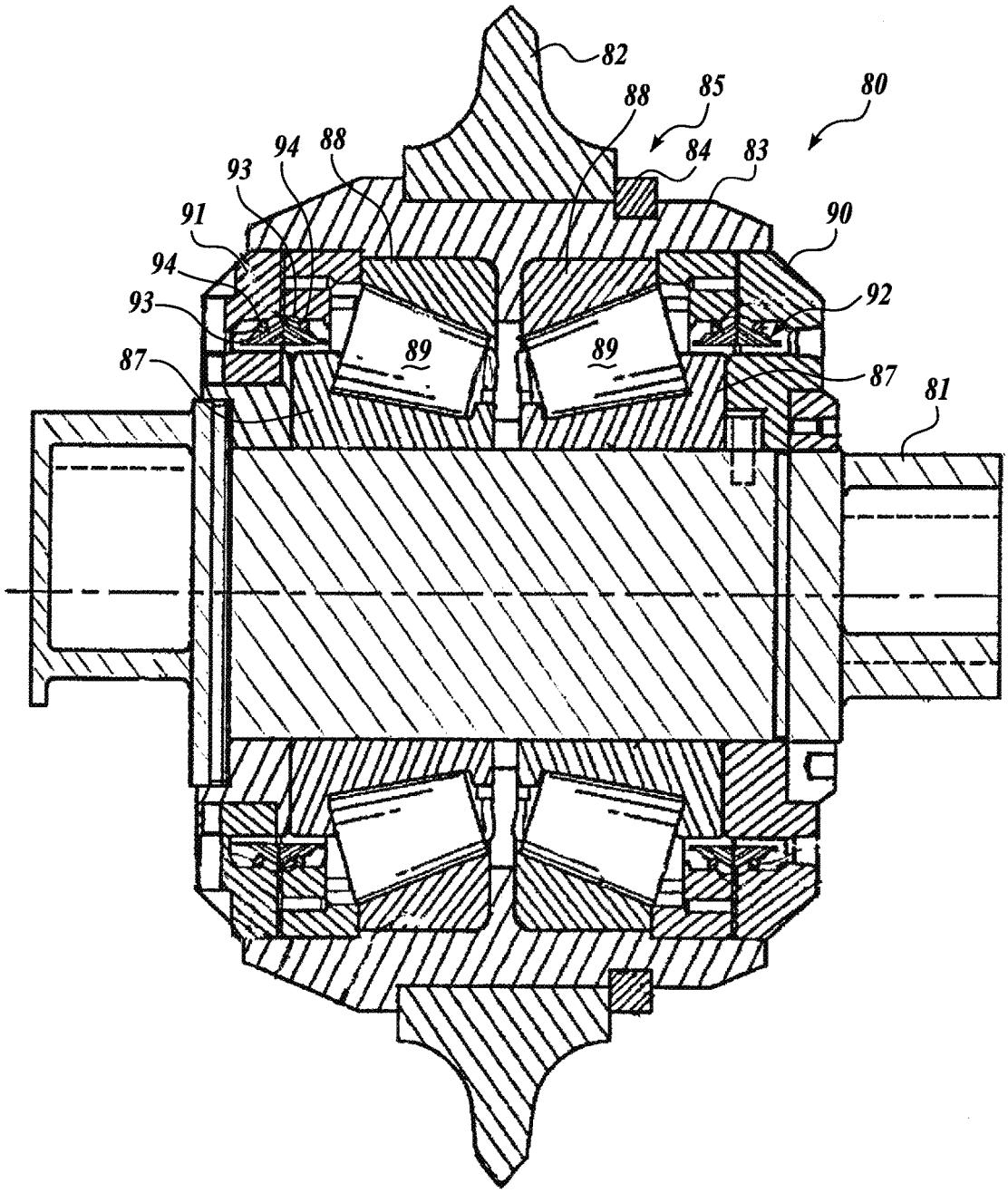
Fig. 1. (PRIOR ART)
FIG. 1 is a cross-sectional front view of a prior art cutter assembly.

It will now be appreciated that the cutter ring 140, which is typically fabricated from a tool steel alloy, has a radially inward base portion 141 that is not significantly thicker than the outer portion 142. For example, the base portion 141 may have a thickness that is not more than 135% of the thickness at a middle radius of the cutter ring 140. Therefore the cutter ring 140 has a relatively small mass as compared to prior art cutter rings. The base portion 141 of the cutter ring 140 is clamped and supported by the hub members 120, 130. The clamping force exerted by the hub members 120, 130 is achieved using the plurality of spaced-apart bolts 150, wherein a gap S between the hub members 120, 130 allows a uniform and consistent clamping force to be reliably applied to the base portion 141 of the cutter ring 140. In addition, the cutter ring 140 geometry is very simple, and relatively easy to fabricate, without the relatively massive base portions found in prior art cutter rings, for example, the prior art cutter ring 82 shown in FIG. 1. In addition, the disc subassembly 110 may be easily disassembled to replace the cutter ring 140.

In an alternative embodiment the base portion 141 of the cutter ring 140 may include geometric features (not shown), for example a ridge or recess, and one or both of the L-shaped recesses 125, 135 of the hub members 120, 130 may include a corresponding geometric feature to engage when the disc subassembly 110 is assembled.

Referring to FIG. 3, to assemble the cutter assembly 100, bearing assemblies 104A, 104B are installed in the first hub member 120, and the cutter ring 140 is positioned on the first annular channel 125. The second hub member 130 is positioned so that the second annular channel 135 engages the cutter ring 140. The hub members 120, 130 are bolted together to produce a desired clamping force on the base 141 of the cutter ring 140. The retainers 106A, 106B and shaft 102 are then installed.

The disc subassembly 110 disclosed above significantly reduces the mass of the cutter ring assembly. For example, a seventeen-inch cutter ring 140 as shown in FIG. 2 had a weight of only 21.2 pounds (9.62 kg), as compared to a corresponding conventional cutter ring having a weight of 54.44 pounds (24.7 kg). More significant is the reduction of forging complexity and cost as the clamped disc forging is a simple rectangular cross section. It is believed that a final machined cost savings in the range of 48% to 60% may be achieved, depending on the forging technique used (e.g., rectangle section roll-forging or closed die forging).

Figure 5:
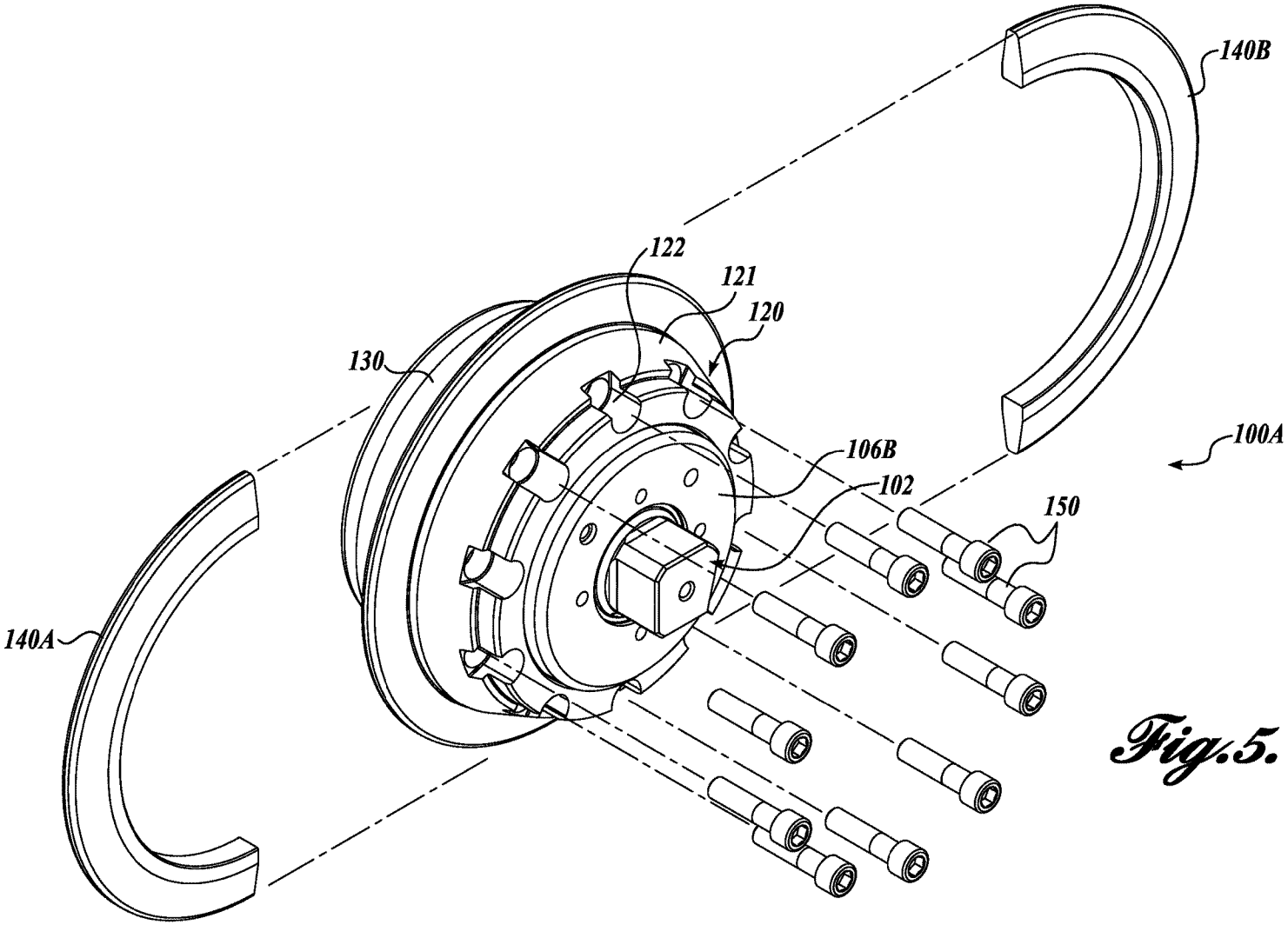
FIG. 5 shows another embodiment of a cutter assembly in accordance with the present invention, wherein the cutter ring comprises a plurality of segments.

In another embodiment shown in partially exploded view in FIG. 5, the cutter assembly 100A has a cutter ring that is formed in more than one section. In the embodiment of FIG. 5 the cutter ring is made in two separable sections 140A and 140B. The cutter assembly 100A is otherwise similar to the cutter assembly 100 shown in FIGS. 2-4. Although a two-section cutter ring 140A, 140B is shown, it will be appreciated that the cutter ring may be formed in more than two parts. Although the cutter ring sections 140A, 140B are shown with planar radial faces on the ends, it is contemplated that the ends may be formed with interlocking geometric features, for example, the cutter ring sections 140A, 140B may be provided with complimentary angled faces that abut when the ring sections 140A, 140B is installed on the cutter assembly.

An advantage of the multi-segment cutter ring 140A, 140B is that the cutter ring segments 140A, 140B may be easily removed and replaced without fully disassembling the cutter assembly 100A, and in some cases without removing the cutter assembly 100A from the cutterhead. The cutter ring segments 140A, 140B may include geometric features in the base portion, and/or may be shaped with tapered opposed walls (as discussed above), to prevent the segments 140A, 140B from inadvertently disengaging from the hub portions.

Figure 6:
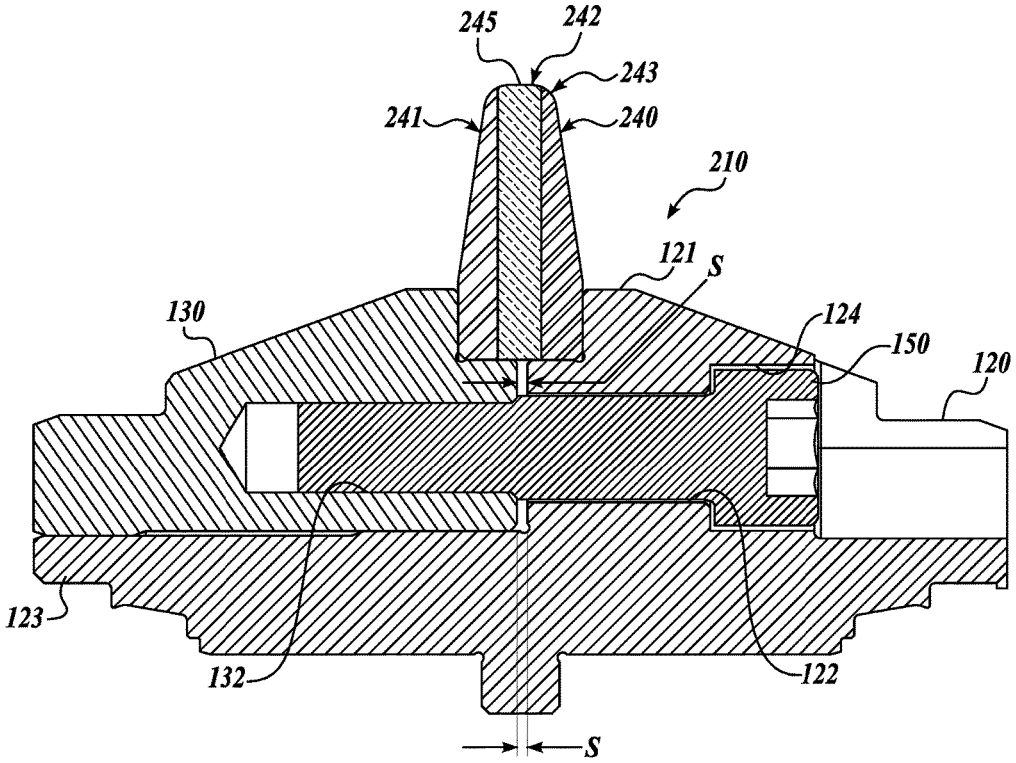
FIG. 6 is a detail cross-sectional view illustrating another embodiment of a cutter ring assembly in accordance with the present invention.

FIG. 6 shows a cross-sectional view of another embodiment of a cutter ring assembly 210 in accordance with the present invention that is similar to the cutter ring assembly 110 disclosed above except as described herein. In this embodiment a cutter ring 240 is formed from three relatively thin, annular members 241, 242, 243 in a sandwich configuration. The outer annular members 241, 243 are formed from a steel, for example a tool steel, and the center annular member 242 is formed from a cemented carbide such as a tungsten carbide, titanium carbide, or tantalum carbide. Tungsten carbide is approximately twice as stiff as steel and has about twice the density of steel. In particular tungsten carbide in the form known as cemented carbide is a hard material made of fine particles Carbide is superior to materials such as carbon steel for cutting of tough materials, and has superior wear characteristics. Although cemented carbides have superior harness and wear properties for tunnel boring operations, they are also significantly more expensive than tool steel, and may be more prone to fracture.

In the embodiment shown in FIG. 6, the carbide member 242 is sandwiched between two steel members 241, 243. The center carbide member 242 is defines the outermost edge 245 of the cutter ring 240, and therefore contacts the rock substrate, and is clampingly supported between the steel members 241, 243, which provide structural support to the carbide member 242 to prevent or reduce fracture of the carbide member 242. In exemplary embodiments the annular layers 241, 242, 243 are bonded together, in addition to the clamping forces provided by the first and second hub members 120, 130. Of course the cutter ring 240 may be formed as a single annular assembly as shown in FIG. 3, or in multiple segments as shown in FIG. 5.

While illustrative embodiments have been illustrated and described, it will be appreciated that various changes can be made therein without departing from the spirit and scope of the invention.

The embodiments of the invention in which an exclusive property or privilege is claimed are defined as follows:

1. A cutter assembly for a tunnel boring machine comprising:

a shaft;

a disc subassembly rotatably mounted on the shaft, wherein the disc subassembly comprises:

(i) a first hub member comprising a tubular portion and a flange portion defining a first annular L-shaped channel;

(ii) a second hub member configured to slidably receive the tubular portion of the first hub member, the second hub member defining a second annular L-shaped channel; and (iii) an annular cutter ring having a base portion defining an inner surface that slidably engages the first and second L-shaped channels; and a plurality of bolts that extend through a plurality of unthreaded apertures in one of the first hub member and the second hub member and threadably engage a corresponding plurality of threaded apertures in the other of the first hub member and the second hub member, such that the first hub member and the second hub member clampingly engage the base portion of the annular cutter ring.

2. The cutter assembly of claim 1, wherein the annular cutter ring comprising a plurality of separable cutter ring segments that cooperatively form the annular cutter ring.

3. The cutter assembly of claim 1, wherein the base portion of the annular cutter ring is wider than a combined width of the first and second L-shaped channels such that a gap is defined between the first L-shaped channel and the second L-shaped channel.

4. The cutter assembly of claim 1, wherein the plurality of unthreaded apertures are uniformly spaced along a circular pattern.

5. The cutter assembly of claim 1, wherein the base portion of the annular cutter ring defines opposed walls that do not diverge by more than fifteen degrees.

6. The cutter assembly of claim 1, wherein the base portion of the annular cutter ring defines opposed walls that are parallel.

7. The cutter assembly of claim 1, wherein the annular cutter ring consists of a tool steel.

8. The cutter assembly of claim 1, wherein the plurality of bolts comprise at least ten bolts.

9. The cutter assembly of claim 1, wherein the disc subassembly is rotatably mounted on the shaft with two tapered bearing assemblies.

10. The cutter assembly of claim 9, further comprising a first retainer mounted to the shaft and sealingly engaging the first hub member, and a second retainer mounted to the shaft and sealingly engaging the second hub member.

11. The cutter assembly of claim 1, wherein the annular cutter ring further comprises a tapered portion extending radially from the cutter ring base portion.

12. The cutter assembly of claim 1, wherein the annular cutter ring comprises at least three annular layers comprising a relatively soft first layer, a relatively hard second layer, and a relatively soft third layer, wherein the second layer is disposed between the first and third layers.

13. The cutter assembly of claim 12, wherein the second layer consists of a cemented carbide and the first and third layers consist of a steel.

14. The cutter assembly of claim 12, wherein the annular first, second, and third layers are bonded together.

15. The cutter assembly of claim 12, wherein the annular cutter ring comprising a plurality of separable cutter ring segments that cooperatively form the annular cutter ring.

16. A cutter assembly for a tunnel boring machine comprising:

a shaft configured to be fixedly mounted onto a cutterhead of the tunnel boring machine;

a first hub member comprising a housing portion and a flange portion extending outwardly from the housing portion;

a first bearing assembly housed in the housing portion of the first hub member and a second bearing assembly housed in the housing portion of the first hub member, wherein the first and second bearing assemblies are mounted on the shaft, such that the first hub member is rotatable about the shaft;

a second hub member that slidably engages the housing portion of the first hub member;

an annular cutter ring having a rectangular base portion and a tapered outer portion extending outwardly from the base portion;

wherein the first and second hub members are joined together with a plurality of bolts, and wherein the first and second hub members cooperatively define an annular channel that receives and produces a clamping force on the rectangular base portion of the annular cutter ring.

17. The cutter assembly of claim 16, wherein the annular cutter ring comprising a plurality of separable cutter ring segments that cooperatively form the annular cutter ring.

18. The cutter assembly of claim 16, wherein the flange portion of the first hub member is spaced apart from the second hub member.

19. The cutter assembly of claim 16, wherein the first hub member comprises a plurality of through holes that slidably receive the plurality of bolts, and the second hub member comprises a corresponding plurality of threaded apertures that threadably receive the plurality of bolts.

20. The cutter assembly of claim 16, wherein the base portion of the annular cutter ring defines opposed walls that do not diverge by more than six degrees.

21. The cutter assembly of claim 16, wherein the base portion of the annular cutter ring defines opposed walls that are parallel.

22. The cutter assembly of claim 16, wherein the annular cutter ring consists of a tool steel.

23. The cutter assembly of claim 16, wherein the plurality of bolts comprise at least ten bolts.

24. The cutter assembly of claim 23, further comprising a first retainer mounted to the shaft and sealingly engaging the first hub member, and a second retainer mounted to the shaft and sealingly engaging the second hub member.

25. The cutter assembly of claim 16, wherein the annular cutter ring further comprises a tapered portion extending radially from the cutter ring base portion.

26. The cutter assembly of claim 16, wherein the annular cutter ring comprises at least three annular layers comprising a relatively soft first layer, a relatively hard second layer, and a relatively soft third layer, wherein the second layer is disposed between the first and third layers.

27. The cutter assembly of claim 26, wherein the second layer consists of a cemented carbide and the first and third layers consist of a steel.

28. The cutter assembly of claim 26, wherein the annular first, second, and third layers are bonded together.

* * * * *